US009340390B2

(12) United States Patent
Ishikawa et al.

(10) Patent No.: US 9,340,390 B2
(45) Date of Patent: May 17, 2016

(54) SHEET PROCESSING APPARATUS, IMAGE FORMING SYSTEM, AND NON-TRANSITORY COMPUTER READABLE MEDIUM

(71) Applicant: FUJI XEROX CO., LTD., Tokyo (JP)

(72) Inventors: Takuya Ishikawa, Kanagawa (JP); Masatoshi Kimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/465,154

(22) Filed: Aug. 21, 2014

(65) Prior Publication Data

US 2015/0105231 A1 Apr. 16, 2015

(30) Foreign Application Priority Data

Oct. 15, 2013 (JP) ..... 2013-215002

(51) Int. Cl.

| | |
|---|---|
| ***B65H 31/04*** | (2006.01) |
| ***B65H 31/08*** | (2006.01) |
| ***B65H 45/04*** | (2006.01) |
| ***B65H 45/20*** | (2006.01) |
| ***B65H 31/10*** | (2006.01) |
| ***B65H 31/26*** | (2006.01) |

(52) U.S. Cl.

CPC ..... *B65H 31/04* (2013.01); *B65H 31/08* (2013.01); *B65H 31/10* (2013.01); *B65H 31/26* (2013.01); *B65H 45/04* (2013.01); *B65H 45/20* (2013.01); *B65H 2301/4223* (2013.01); *B65H 2405/115* (2013.01); *B65H 2511/15* (2013.01); *B65H 2511/20* (2013.01); *B65H 2511/214* (2013.01); *B65H 2511/51* (2013.01); *B65H 2553/80* (2013.01); *B65H 2701/11232* (2013.01); *B65H 2701/11238* (2013.01); *B65H 2801/27* (2013.01)

(58) Field of Classification Search

CPC ..... B65H 31/04; B65H 31/08; B65H 31/10; B65H 45/04; B65H 45/20

USPC ..... 270/32, 37, 39.01, 39.06, 58.13, 58.14, 270/58.15, 58.18, 58.19, 58.28; 271/213, 271/220

See application file for complete search history.

(56) References Cited

U.S. PATENT DOCUMENTS

| | | | | |
|---|---|---|---|---|
| 6,217,016 | B1 * | 4/2001 | Honmochi et al. | 270/37 |
| 6,302,389 | B1 * | 10/2001 | Kato et al. | 270/58.13 |
| 6,712,349 | B2 * | 3/2004 | Watanabe | 270/37 |
| 7,392,983 | B2 * | 7/2008 | Kodama et al. | 271/249 |
| 7,549,621 | B2 * | 6/2009 | Kotani | 270/58.13 |
| 7,762,541 | B2 * | 7/2010 | Harashina | 270/58.13 |
| 7,798,481 | B2 * | 9/2010 | Terao et al. | 270/58.13 |

FOREIGN PATENT DOCUMENTS

| | | |
|---|---|---|
| JP | A-2005-1779 | 1/2005 |

* cited by examiner

*Primary Examiner* — Leslie A Nicholson, III
(74) *Attorney, Agent, or Firm* — Oliff PLC

(57) ABSTRACT

A sheet processing apparatus includes a vertically movable tray that moves vertically in accordance with an amount of stacked folded sheets which are transported and stacked thereon, a plate that is disposed above the vertically movable tray and that does not move in accordance with transport of a folded sheet, a recognizing unit that recognizes a predetermined height state of a sheet stacked on the vertically movable tray, and a controller that controls the vertically movable tray so as to, in response to a recognition of the predetermined height state of the sheet by the recognizing unit, move the vertically movable tray upward, press the sheet stacked on the vertically movable tray against the plate, and subsequently move the vertically movable tray downward.

10 Claims, 6 Drawing Sheets

50
57
52, 52a
SHEET
61
99
p1
62
63
52, 52b
52, 52c
67
66
65
64
100
60
p2

SHEET PROCESSING APPARATUS, IMAGE FORMING SYSTEM, AND NON-TRANSITORY COMPUTER READABLE MEDIUM

CROSS-REFERENCE TO RELATED APPLICATIONS

This application is based on and claims priority under 35 USC 119 from Japanese Patent Application No. 2013-215002 filed Oct. 15, 2013.

BACKGROUND

The present invention relates to a sheet processing apparatus, an image forming system, and a non-transitory computer readable medium storing a program for controlling a sheet processing apparatus.

SUMMARY

According to an aspect of the invention, there is provided a sheet processing apparatus including: a vertically movable tray that moves vertically in accordance with an amount of stacked folded sheets which are transported and stacked thereon; a plate that is disposed above the vertically movable tray and that does not move in accordance with transport of a folded sheet; a recognizing unit that recognizes a predetermined height state of a sheet stacked on the vertically movable tray; and a controller that controls the vertically movable tray so as to, in response to a recognition of the predetermined height state of the sheet by the recognizing unit, move the vertically movable tray upward, press the sheet stacked on the vertically movable tray against the plate, and subsequently move the vertically movable tray downward.

BRIEF DESCRIPTION OF THE DRAWINGS

An exemplary embodiment of the present invention will be described in detail based on the following figures, wherein.

DETAILED DESCRIPTION

An exemplary embodiment of the present invention will now be described in detail with reference to the accompanying drawings.

Figure 1:
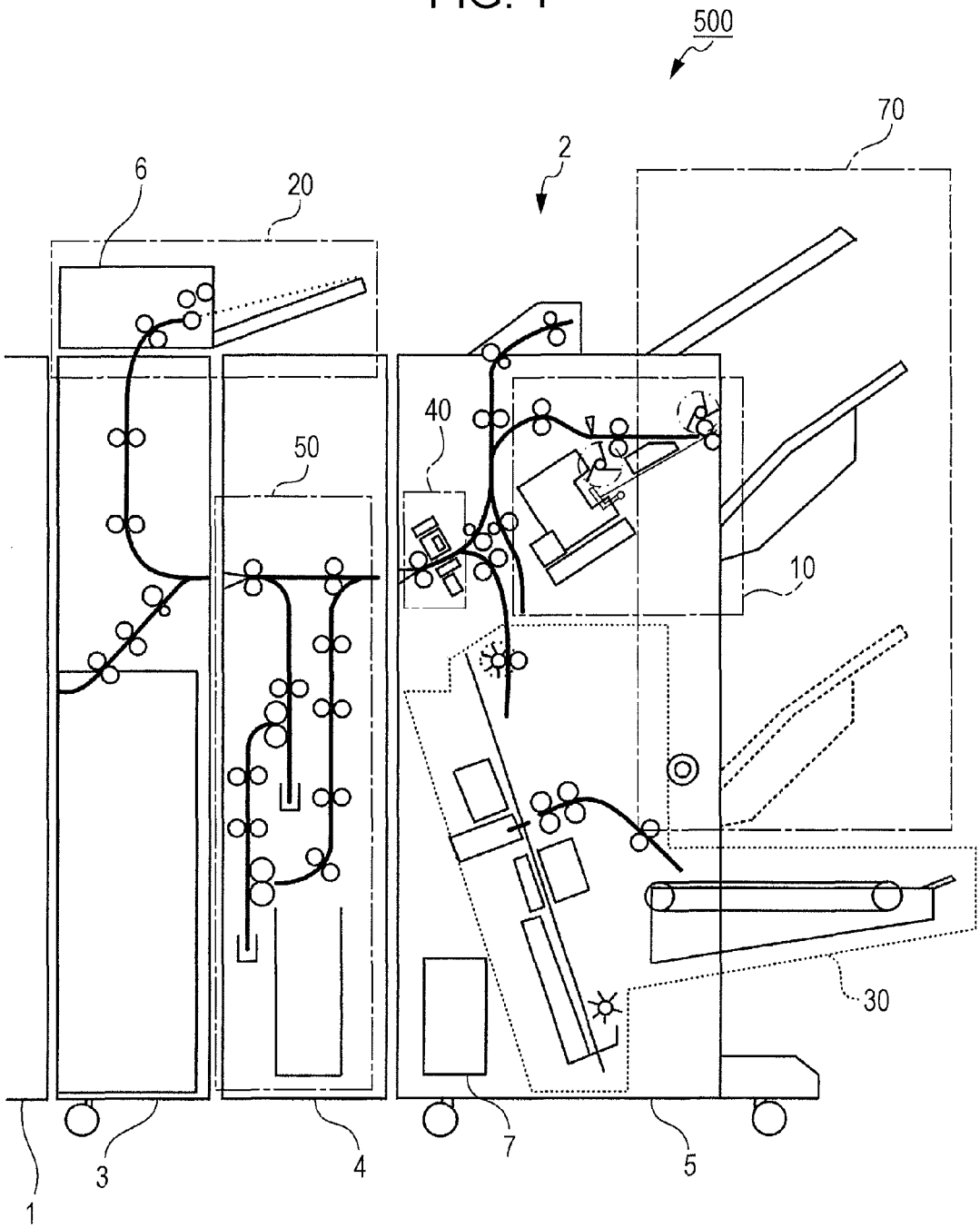
FIG. 1 illustrates the overall configuration of an image forming system to which an exemplary embodiment is applied.

FIG. 1 illustrates the overall configuration of an image forming system 500 to which the present exemplary embodiment is applied.

The image forming system 500 to which the present exemplary embodiment is applied includes an image forming apparatus 1 that forms a color image using an electrophotographic system, for example. The image forming system 500 also includes a sheet processing apparatus 2 that performs predetermined post-processing on a sheet transported from the image forming apparatus 1.

The image forming apparatus 1 may be configured by including, for example, a photoconductor drum that carries an electrostatic latent image, a charging device that charges the photoconductor drum, a laser exposure device that irradiates the photoconductor drum with a laser light and forms an electrostatic latent image, a developing device that develops the electrostatic latent image formed on the photoconductor drum with a toner, and a transfer device that transfers a toner image formed on the photoconductor drum onto a sheet. The image forming apparatus 1 serving as an image forming unit may form an image using an electrophotographic system, or may form an image using an inkjet system, for example.

The sheet processing apparatus 2 includes a transport unit 3 connected to the image forming apparatus 1, and a folding unit 4 that performs folding processing on a sheet loaded by the transport unit 3. The folding unit 4 has plural folding processing parts (folding parts) that perform folding processing on a sheet. The sheet processing apparatus 2 also includes a finisher 5 that performs predetermined post-processing on the sheet having passed through the folding unit 4, and an interposer 6 that feeds an interleaf such as a cover of a booklet. The sheet processing apparatus 2 also includes a control unit 7 that serves as a controller which controls each mechanism of the sheet processing apparatus 2. In FIG. 1, the control unit 7 is provided in a housing of the finisher 5. However, the control unit 7 may be provided in a housing of another unit, such as the transport unit 3, and the folding unit 4. Alternatively, all the control functions may be provided by the image forming apparatus 1.

The following describes the functional configuration of the sheet processing apparatus 2. The sheet processing apparatus 2 includes a stapling function section 10 that is provided in the finisher 5 and that forms a sheet bundle so as to perform stapling; an interleaving function section 20 that includes the interposer 6 and feeds an interleaf, such as cardboard and a sheet with a window, used as a cover of a sheet bundle; a saddle stitching function section 30 that is provided in the finisher 5 and saddle-stitches the sheet bundle; a punching function section 40 that is provided in the finisher 5 and performs two-hole or four-hole punching on a sheet; and a folding function section 50 that is provided in the folding unit 4 and serves as one of folding processing units which perform outward three-folding (Z-folding) or inward three-folding (C-folding) on a sheet. The sheet processing apparatus 2 also includes a sheet stacking function section 70 that stacks ejected sheets (output sheets). The punching function section 40, the stapling function section 10, an ejection roller pair 71 (described below), and so on that are provided on the downstream side of the folding function section 50 serve as transporting units capable of transporting folded sheets.

The folding function section 50 will be described in detail.

Figure 2:
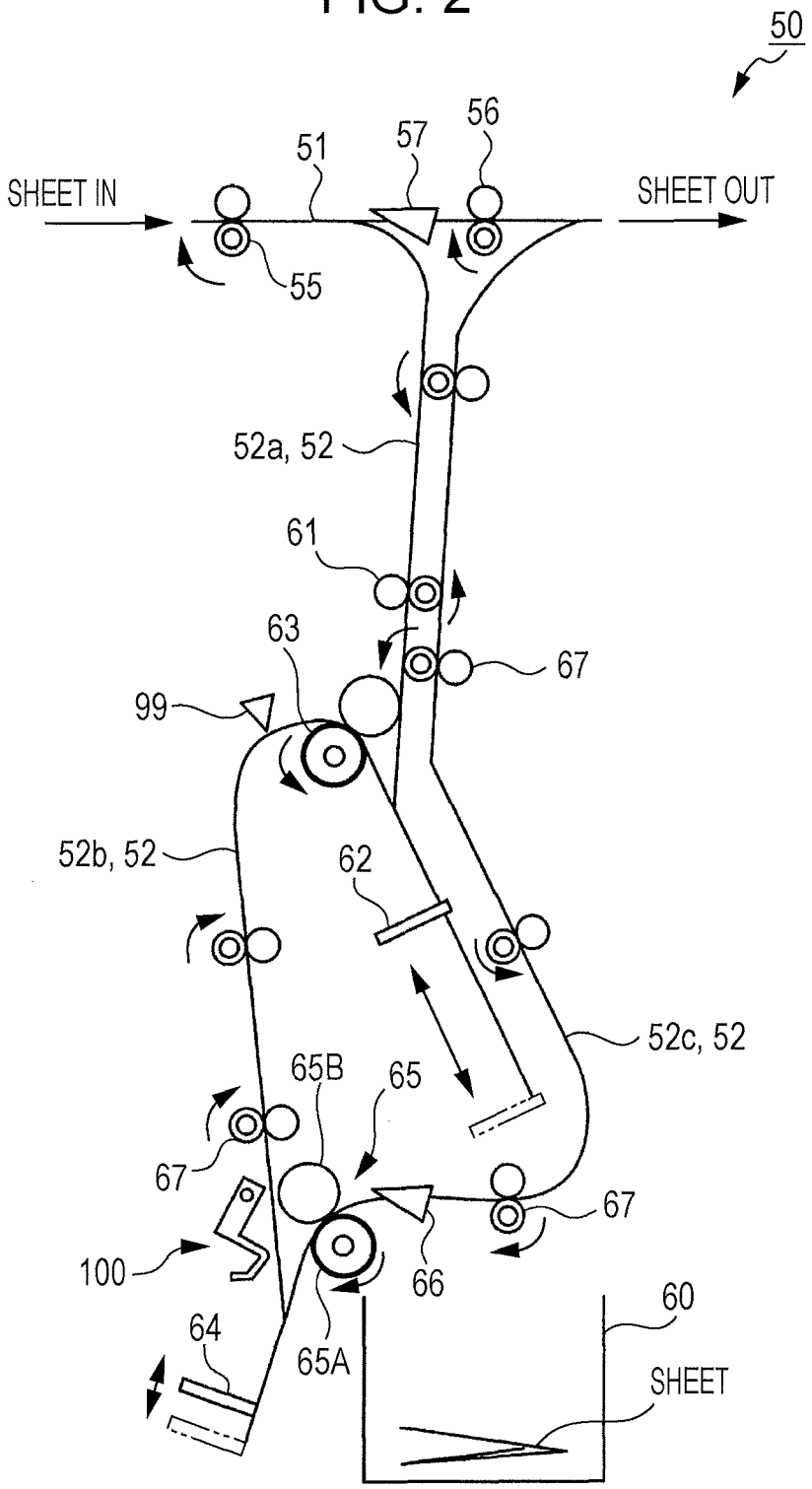
FIG. 2 is an explanatory diagram illustrating the details of a folding function section provided in a folding unit.

FIG. 2 is an explanatory diagram illustrating the details of the folding function section 50 provided in the folding unit 4.

The folding function section 50 includes a linear transport path 51 that linearly connects a sheet inlet and a sheet outlet which are opened at the upper part of the housing, and a bypass transport path 52 that branches off from the linear transport path 51 and then joins the linear transport path 51 again. In this exemplary embodiment, a folding mechanism that performs outward three-folding (Z-folding) or inward three-folding (C-folding) on a sheet is provided in the middle of the bypass transport path 52. Further, in this exemplary embodiment, a loading roller 55 is provided near the inlet of the linear transport path 51, and a transport roller 56 is provided in the middle of the linear transport path 51. Furthermore, a switching gate 57 is provided at a point where the bypass transport path 52 branches off from the linear transport path 51.

The bypass transport path 52 includes an inlet bypass transport path 52*a* that extends downward from the branching point from the linear transport path 51, an intermediate bypass transport path 52*b* that branches off from the middle of the inlet bypass transport path 52*a* so as to form a substantially C shape, and a return bypass transport path 52*c* that branches off from the middle of the intermediate bypass transport path 52*b*. In this exemplary embodiment, folding processing is performed on a sheet two times while the sheet is transported along the bypass transport path 52.

A skew correction roller 61 capable of releasing nipping is provided in the middle of the inlet bypass transport path 52*a*. A vertically movable first end guide 62 is provided at the terminal end of the inlet bypass transport path 52*a*. Further, a first folding roller 63 serving as a part of the folding parts is provided near a joint between the intermediate bypass transport path 52*b* and the inlet bypass transport path 52*a*, on the intermediate bypass transport path 52*b*. Furthermore, a vertically movable second end guide 64 is provided at the terminal end of the intermediate bypass transport path 52*b*. In this exemplary embodiment, a position where folding processing is performed on a sheet changes in accordance with the position of the first end guide 62 and the position of the second end guide 64.

Second folding rollers 65 serving as a part of the folding parts are provided at an upstream portion of the return bypass transport path 52*c* in a sheet transport direction (near a joint between the intermediate bypass transport path 52*b* and the return bypass transport path 52*c*). The second folding rollers 65, which also serve as a transporting unit, include a first transport roller 65A, and a second transport roller 65B that is disposed in contact with the first transport roller 65A.

The first transport roller 65A as an example of a first transport member is rotated in a clockwise direction in FIG. 2 by a driving force of a driving source (not illustrated). The second transport roller 65B as an example of a second transport member is disposed in contact with the first transport roller 65A and is driven by the first transport roller 65A so as to be rotated in a counterclockwise direction in FIG. 2. In this exemplary embodiment, a sheet is sent to the contact part (nip part) between the first and second transport rollers 65A and 65B from the upstream side, folding processing is performed on the sheet. Then, the sheet subjected to the folding process is further transported to the downstream side by the first and second transport rollers 65A and 65B.

A switching gate 66 that switches whether to allow a sheet to pass through the return bypass transport path 52*c* is provided immediately behind (on the downstream side of) the second folding rollers 65. Further, a sheet storage device 60 that stores envelope-folded sheets subjected to outward three-folding (Z-folding) or the like (sheets that are folded so as to be inserted into envelopes) is provided under the switching gate 66.

Plural transport rollers 67 are provided on the bypass transport path 52. Further, in this exemplary embodiment, a sheet detection sensor 99 is provided near the first folding roller 63, at an upstream portion of the intermediate bypass transport path 52*b*. Furthermore, a sheet guide 100 is provided near the second folding rollers 65, in the middle of the intermediate bypass transport path 52*b*.

Next, the operation of the folding function section 50 will be described with reference to FIGS. 3A through 3C.

In the following, folding processing for outward three-folding (Z-folding) that is performed on an A3 size sheet will be described.

Figures 3A, 3B, 3C:
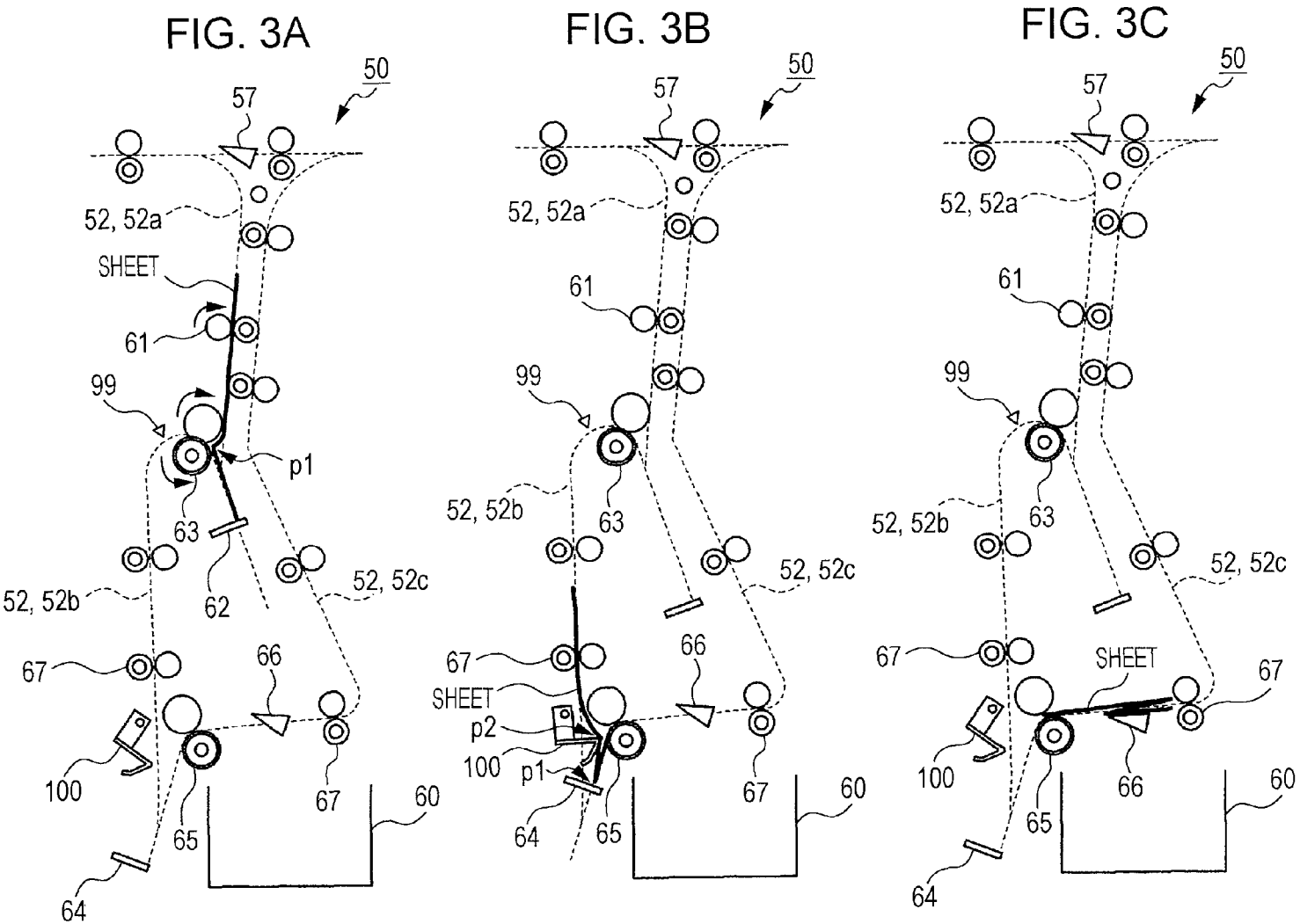
FIGS. 3A through 3C are explanatory diagrams illustrating operations for performing outward three-folding (Z-folding) on a sheet.

FIGS. 3A through 3C are explanatory diagrams illustrating operations for performing outward three-folding (Z-folding) on a sheet.

In the folding function section 50, when an instruction for Z-folding is issued from the user through, for example, an operation input section (not illustrated) of the image forming apparatus 1, the switching gate 57 is driven so as to guide a sheet to the inlet bypass transport path 52*a*, as illustrated in FIG. 3A.

Further, when the instruction for Z-folding is issued from the user, the first and second end guides 62 and 64 are moved to predetermined positions. In particular, the position of the first end guide 62 is adjusted so as to correspond to ¼ the size of the sheet to be folded.

After that, the sheet from the image forming apparatus 1 is introduced into the inlet bypass transport path 52*a*. Then, the sheet is transported via the skew correction roller 61 as illustrated in FIG. 3A, and is further transported until the leading edge of the sheet abuts the first end guide 62. In this step, skew of the sheet is corrected.

Then, the sheet having the skew corrected is transported at a speed equal to or lower than the speed of the first folding roller 63, while the leading edge of the sheet is maintained abutting the first end guide 62. Thus, a folded portion (see reference numeral p1) of the sheet is buckled so as to form a loop in the space in front of the first folding roller 63. Then, this folded portion is sent to the first folding roller 63, so that first folding processing is performed.

After that, the sheet is transported along the intermediate bypass transport path 52*b*. At this point, the folded edge (leading edge) of the sheet is recognized by the sheet detection sensor 99. Subsequently, the folded edge (leading edge) of the sheet having been transported along the intermediate bypass transport path 52*b* abuts the second end guide 64. Then, a solenoid is turned on, so that the sheet guide 100 pushes the middle portion (the position indicated by reference numeral p2) of the sheet toward the second folding rollers 65 in the space in front of the second folding rollers 65, as illustrated in FIG. 3B. Thus, second folding processing is performed on a portion different from a portion on which the first folding processing has been performed.

The timing when the sheet guide 100 pushes the sheet toward the second folding rollers 65 is set on the basis of recognition of the folded edge (leading edge) by the sheet detection sensor 99.

After completion of the second folding processing, the sheet passes through the switching gate 66 as illustrated in FIG. 3C, and is transported toward the sheet outlet by the plural transport rollers 67. The sheet (Z-folded sheet) having been subjected to the second folding processing and folded in a Z-shape is transported with the Z-folded portion (folded-over portion) at the leading edge side, and is output from the folding function section 50 via the return bypass transport path 52*c*. Then, the Z-folded sheet is transported to the sheet stacking function section 70 via the punching function section 40, with the Z-folded portion (folded-over portion) at the leading edge side.

Next, the sheet stacking function section 70 will be described in detail.

Figure 4:
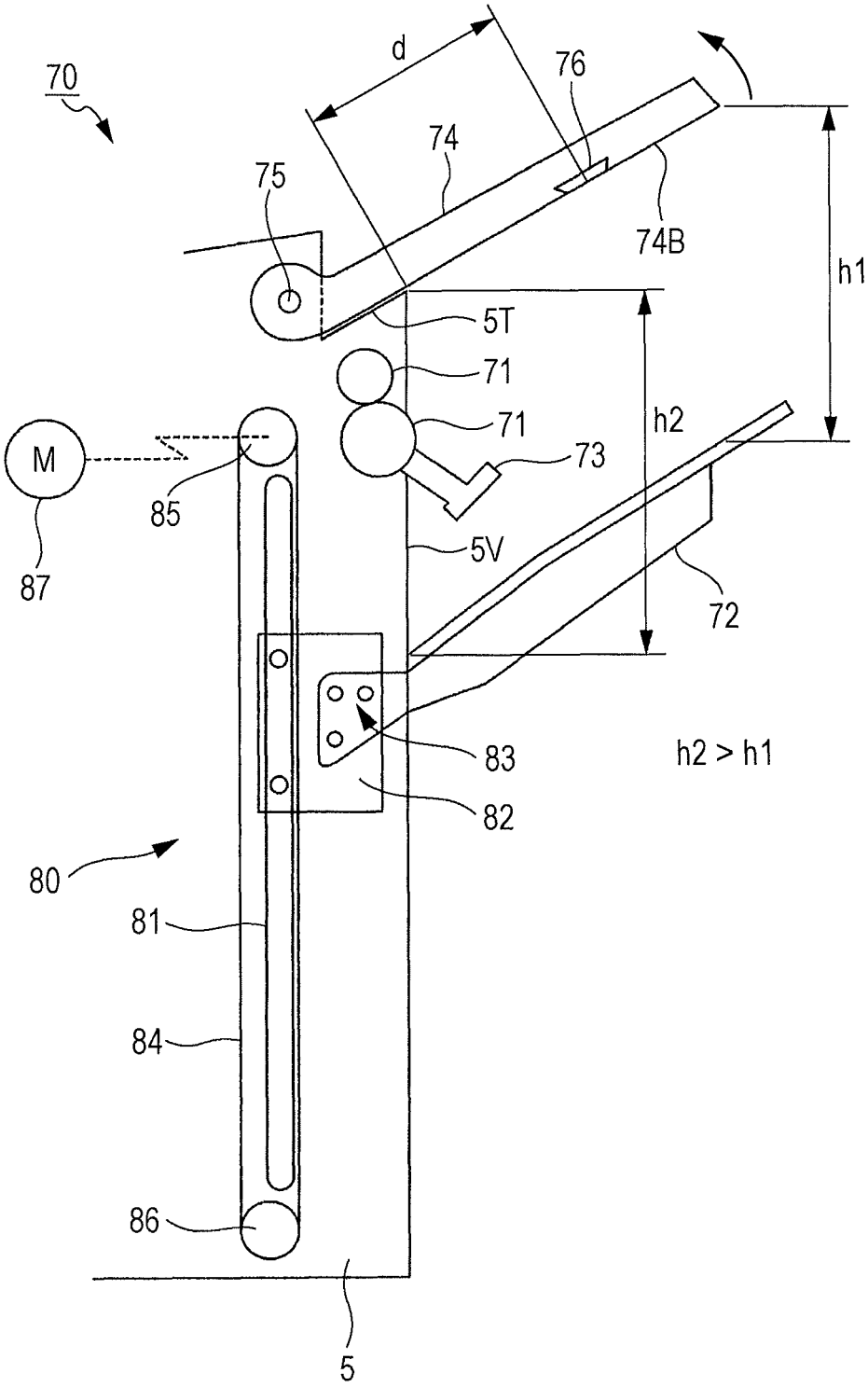
FIG. 4 is a configuration diagram illustrating a sheet stacking function section.

FIG. 4 is a configuration diagram illustrating the sheet stacking function section 70. The sheet stacking function section 70 includes the ejection roller pair 71 serving as one of transporting units that eject a sheet subjected to folding processing, and a stacker tray 72 as a vertically movable tray that receives the sheet ejected by the ejection roller pair 71 and stacks the sheet thereon. The sheet stacking function section 70 also includes a setting clamp 73 that presses an upstream portion of the sheet stacked on the stacker tray 72 in the sheet transport direction. The sheet stacking function section 70 also includes a top tray 74 which is disposed above the stacker tray 72 and onto which a sheet that is transported without passing through the stapling function section 10 is ejected. This top tray 74 is a paper output tray that stacks non-folded sheets, and is a plate that does not move in accordance with transport of a folded sheet. The sheet stacking function section 70 also includes a hinge part 75 that supports the top tray 74 so as to allow the top tray 74 to rotate counterclockwise and move upward, and a swelling detection sensor 76 that is disposed on the top tray 74 and detects a sheet stacked on the top tray 74. The swelling detection sensor 76 is disposed on a lower surface of the top tray 74. The swelling detection sensor 76 serves as one of recognizing units that recognize a predetermined height state of the sheet stacked on the stacker tray 72.

The stacker tray 72 is moved up and down (moved vertically) by a moving mechanism 80. Upward and downward movements by the moving mechanism 80 are controlled by the control unit 7 of FIG. 1.

The top tray 74 is placed on an upper housing surface 5T of the housing of the finisher 5 by its own weight, with its lower surface 74B in contact with the upper housing surface 5T, and is positioned by being supported by the upper housing surface 5T. The hinge part 75 is disposed on the upstream side in the sheet transport direction, and is a fulcrum of rotation of the top tray 74. The hinge part 75 may be formed, for example, on a housing surface of the finisher 5. More specifically, the hinge part 75 may be formed using, for example, short rotary shafts respectively extending from two surfaces protruding toward the "IN" side (far side) and the "OUT" side (the near side), that is, two surfaces protruding in a perpendicular direction on a plane in the sheet transport direction of the finisher 5. The user rotates the top tray 74 upward when removing sheets stacked on the stacker tray 72. Thus, the sheets stacked on the stacker tray 72 are easily removed.

The following describes the relationship between the stacker tray 72 serving as a vertically movable tray and the top tray 74 serving as a plate with reference to FIG. 4. A vertical distance h1 between the stacker tray 72 and the top tray 74 on the downstream side in the transport direction is less than a vertical distance h2 therebetween on the upstream side in the transport direction. Thus, a downstream portion of the sheet, that is, a leading edge portion of the sheet stacked on the stacker tray 72 is more likely to come into contact with the top tray 74 as the stacker tray 72 is moved up. This makes it possible to surely press the leading edge portion of the sheet against the top tray 74.

The swelling detection sensor 76 is configured to detect whether the lower surface 74B of the top tray 74 and the sheet stacked on the stacker tray 72 are in a "predetermined height state". The "predetermined height state" may be a state in which the distance between the sheet stacked on the stacker tray 72 and the lower surface 74B of the top tray 74 is a predetermined distance. The predetermined distance may preferably be in a range of, for example, 5 mm to 20 mm in view of the performance of the sensor. As the swelling detection sensor 76 that detects such a distance, a reflective photosensor or the like may be used, for example. Note that the swelling detection sensor 76 does not have to be located on the lower surface 74B of the top tray 74, and may be located anywhere as long as the swelling detection sensor 76 can detect the "predetermined height state". Alternatively, the "predetermined height state" may be, for example, a state in which a sheet stacked on the stacker tray 72 is in contact with the lower surface 74B of the top tray 74. In this case, as the swelling detection sensor 76, a pressure sensor or the like may be used, for example.

The following describes the detection position of the swelling detection sensor 76 in greater detail.

The detection position of the swelling detection sensor 76 is preferably a position where the swelling detection sensor 76 can recognize that a "folded-over position" of a Z-folded sheet on the stacker tray 72 is in a predetermined height state. The "folded-over position" of a Z-folded sheet varies depending on the size of the sheet that is transported. For example, in the case where the image forming system 500 is capable of performing Z-folding on A3 size sheets and Z-folding on B4 size sheets, the swelling detection sensor 76 is preferably able to detect the "folded-over position" of these two different sizes of sheets.

The following describes the "folded-over position" in greater detail. For example, in the case where an A3 size sheet is Z-folded in to an A4 size, the length of the sheet in the transport direction is equal to the length (210 mm) of the short side of an A4 size sheet. Accordingly, if the sheet is transported with the Z-folded portion at the forward side (at the leading edge side), the "folded-over position" is from a position of ½ the length (210 mm) of the short side of an A4 size (a position 105 mm apart from the trailing edge) to the leading edge (a position 210 mm apart from the trailing edge) of the Z-folded sheet. Further, for example, in the case where a B4 size sheet is Z-folded, the length of the sheet in the transport direction is equal to the length (182 mm) of the short side of a B5 size sheet. Accordingly, if the sheet is transported with the Z-folded portion at the forward side (at the leading edge side), the "folded-over position" is from a position of ½ the length (182 mm) of the short side of a B5 size (a position 91 mm apart from the trailing edge) to the leading edge (a position 182 mm apart from the trailing edge) of the Z-folded sheet.

Herein, it is assumed that a sheet stacked on the stacker tray 72 is moved vertically along a vertical surface 5V of the finisher 5, and that a sheet stacking surface of the stacker tray 72 and the lower surface 74B of the top tray 74 are substantially parallel to each other. The folded-over position of a Z-folded A3 sheet is a position 105 mm to 210 mm apart from the vertical surface 5V at the trailing edge, and the folded-over position of a Z-folded B4 sheet is a position 91 mm to 182 mm apart from the vertical surface 5V at the trailing edge. In order to detect the folded-over positions of the these two sizes of Z-folded sheets, a distance d (see FIG. 4) from the vertical surface 5V of the finisher 5 to the detection position of the swelling detection sensor 76 on the lower surface 74B of the top tray 74 is set so as to be able to detect a position 105 mm to 182 mm apart from the vertical surface 5V at the trailing edge. In this manner, in an image forming system capable of performing Z-folding on plural sizes of sheets, a position from a start position of a Z-fold of the maximum size sheet (the center of the folded maximum size sheet) to an end position of a Z-fold of the minimum size sheet (the edge of the folded minimum size sheet) is selected. By arranging the swelling detection sensor 76 so as to be able to detect the presence of a sheet at this selected position, it is possible to detect a folded-over position of a Z-folded sheet in the image forming system capable of performing Z-folding on plural sizes of sheets.

Although the detection position of the swelling detection sensor 76 has been described in connection with an example in which Z-folding is performed, a configuration that enables recognition of a folded-over portion in the case of, for example, so-called bag-folding, double-folding and the like, other than Z-folding. For example, in the case of bag-folding and double-folding, the detection position starts from the vertical surface 5V and ends at, for example, ⅓ or ½ the sheet size. If it is difficult to perform detection with a single swelling detection sensor 76, plural detection sensors 76 may be provided.

Next, the moving mechanism 80 that lifts and lowers the stacker tray 72 will be described.

The moving mechanism 80 includes a guide 81 formed from the upper side to the lower side of the finisher 5, and a sliding member 82 that slides upward or downward while being guided by the guide 81. The stacker tray 72 is fastened to the sliding member 82 by fastening parts 83 provided at plural positions (for example, three positions), and is moved vertically by the upward and downward movements of the sliding member 82.

The moving mechanism 80 also includes an endless belt member 84, and a first pulley 85 and a second pulley 86 that are spaced apart from each other in the vertical direction so as to support the belt member 84 from the inside and to apply tension to the belt member 84. The moving mechanism 80 also includes a motor 87 that drives the belt member 84 via the first pulley 85. The sliding member 82 is fixed to the belt member 84, and moves vertically in conjunction with the movement of the belt member 84.

When the control unit 7 rotates the motor 87 in, for example, the forward direction (one direction), the sliding member 82 slides downward in accordance with the movement of the belt member 84. Thus, the stacker tray 72 moves downward. On the other hand, when the control unit 7 rotates the motor 87 in the opposite direction (the other direction), the sliding member 82 slides upward in accordance with the movement of the belt member 84. Thus, the stacker tray 72 moves upward. These movements are controlled by, for example, the stepping motion of the motor 87.

Next, a moving operation of the stacker tray 72 controlled by the control unit 7 will be described with reference to FIGS. 5A through 5D and FIG. 6.

Figure 5A:
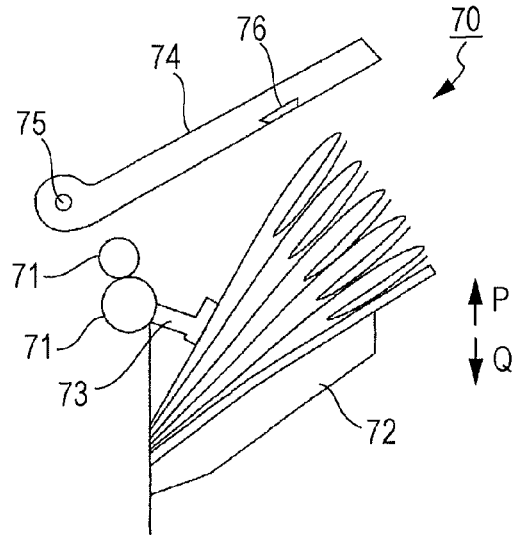
FIGS. 5A through 5D are explanatory diagrams illustrating the overview of operations by a stacker tray for squashing swelling of folds.
Figure 5B:
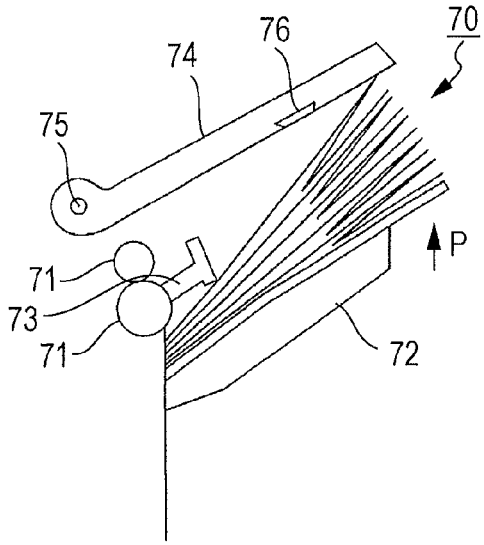
Figure 5C:
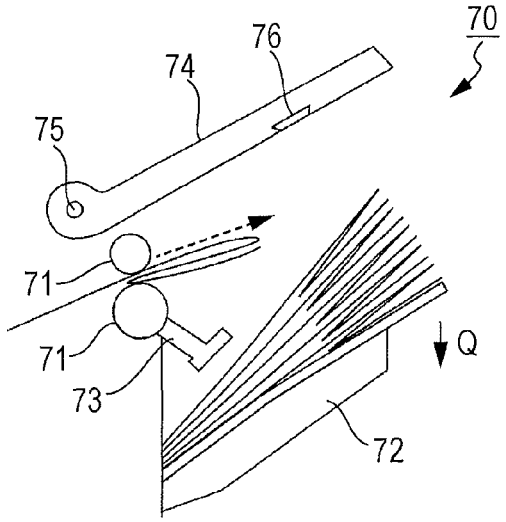
Figure 5D:
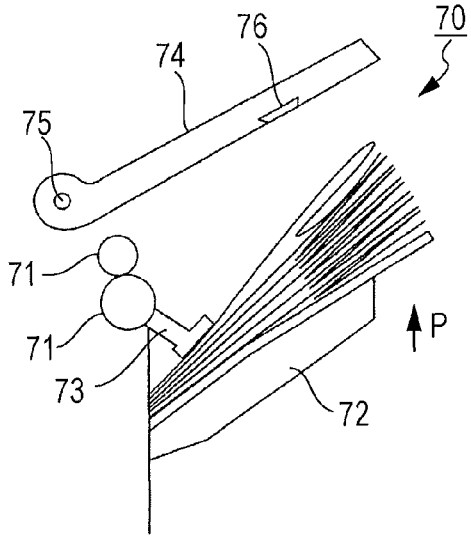
Figure 6:
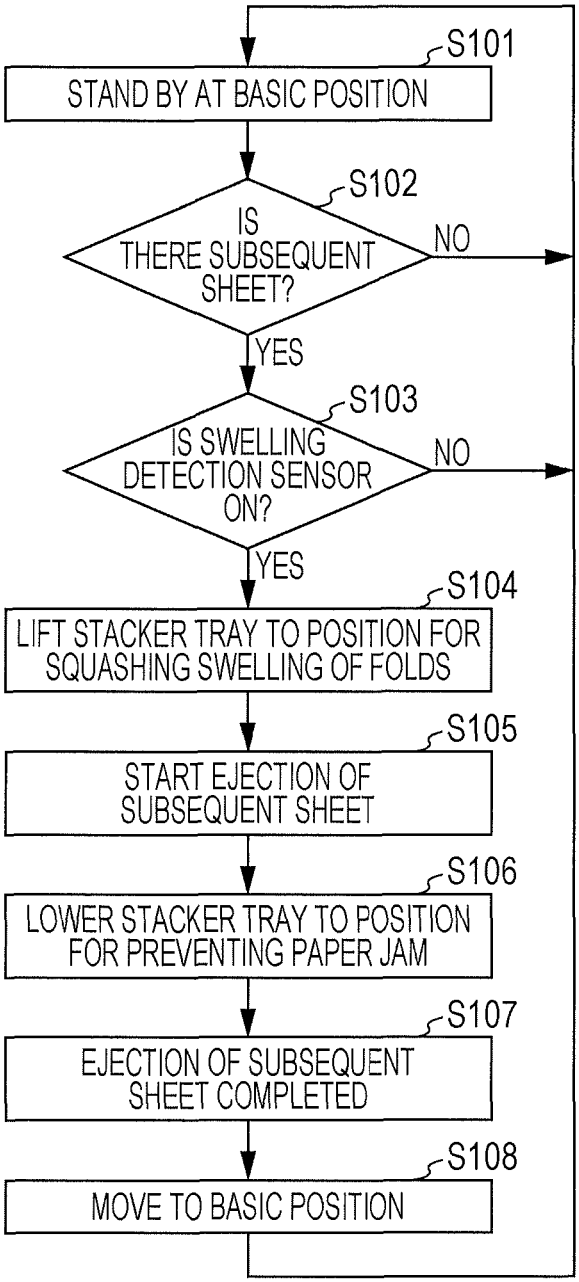
FIG. 6 is a flowchart illustrating the flow of the operations by the stacker tray for squashing swelling of folds.

FIGS. 5A through 5D are explanatory diagrams illustrating the overview of operations by the stacker tray 72 for squashing swelling of folds. FIG. 6 is a flowchart illustrating the flow of the operation by the stacker tray 72 for squashing swelling of folds. FIG. 5A illustrates a standby state in a basic position, and FIG. 5B illustrates a lifted state of the stacker tray 72. Further, FIG. 5C illustrates the stacker tray 72 in a lowered state upon ejection of the next sheet, and FIG. 5D illustrates the stacker tray 72 moved to the basic position.

First, as illustrated in FIG. 5A, the control unit 7 rotates the motor 87 (FIG. 4) so as to move the stacker tray 72 to the basic position, and causes the stacker tray 72 to stop and stand by at the basic position (step S101). When a sheet is ejected, the setting clamp 73 is lifted to a position where the setting clamp 73 does not interfere with the ejection of the sheet. Then, after the sheet is ejected, the setting clamp 73 is lowered so as to press the sheet. The basic position where the stacker tray 72 stands by is a position at a height aligned on the basis of the upper surface of the sheet detected by the setting clamp 73. More specifically, the setting clamp 73 rotates about a rotary shaft (not illustrated). A rotation amount detection sensor (not illustrated) for detecting the amount of rotation is attached to the rotary shaft. The control unit 7 detects the upper surface of the sheet stacked on the stacker tray 72 on the basis of the amount of rotation detected by the rotation amount detection sensor, and causes the stacker tray 72 to stop and stand by at the basis position. FIG. 5A illustrates the sheets being pressed by the setting clamp 73. In FIG. 5A, Z-folded sheets having folds with swelling is illustrated.

Then, the control unit 7 determines whether there is a subsequent sheet (step S102). If there is no subsequent sheet (NO in step S102), the process returns to step 5101, in which the stacker tray 72 stands by at the basic position. If there is a subsequent sheet (YES in step S102), the control unit 7 determines whether the swelling detection sensor 76 is ON (step S103). If the swelling detection sensor 76 is not ON (NO in step S103), the process returns to step S101, in which the stacker tray 72 stands by at the basic position. If the swelling detection sensor 76 is ON (YES in step S103), the control unit 7 causes the stacker tray 72 to be lifted to a position for squashing swelling of folds of the sheets (step S104). The position for squashing swelling of folds of the sheets is a position higher than the basic position of the stacker tray 72 by, for example, about 3 to 5 mm.

FIG. 5B illustrates the stacker tray 72 that is lifted (moved in a P direction) in step S104, and swelling of the Z-folded sheets is squashed. The process of squashing swelling is performed by bringing a portion around the leading edge of the sheet stacked on the stacker tray 72 into contact with the top tray 74, and further lifting the stacker tray 72 so as to hold the sheets between the stacker tray 72 and the top tray 74. In this step, the folded edge may be brought into contact, or a portion slightly apart from the folded edge may be brought into contact. Further, the portion that has first been brought into contact with the top tray 74 may be the only portion that is brought into contact, or the sheet may be first brought into point contact and then brought into surface contact as the top tray 74 is lifted. The top tray 74 receives, by its own weight, the sheets that are pushed up by the upward movement of the stacker tray 72, at the lower side thereof on the downstream side of the hinge part 75 as the fulcrum in the sheet transport direction. If the force applied to the sheets by the upward movement of the stacker tray 72 is greater than the force of receiving the sheets by the weight of the top tray 74, the top tray 74 is rotated upward about the hinge part 75. Accordingly, since the top tray 74 is a gravity type, even in the case where, for example, an impact that causes the squashed and hardened sheets to hit the top tray 74 is applied, the top tray 74 is pushed up so as to avoid the impact. That is, with this configuration, it is possible to reduce damage to the various mechanism elements due to impact between the top tray 74 and the stacker tray 72.

Then, ejection of the subsequent sheet starts (step S105), and the control unit 7 causes the motor 87 (see FIG. 4) to rotate in the opposite direction so as to lower the stacker tray 72 to a position for preventing paper jams (step S106). That is, if the stacker tray 72 simply remains lifted, the next sheet to be ejected might get jammed. In view of this, the stacker tray 72 is lowered before the next sheet is ejected, thereby securing the space. The stacker tray 72 is lowered to a position where the sheet transported by the ejection roller pair 71 as one of transporting units is stacked thereon.

FIG. 5C illustrates a state in which ejection of the subsequent sheet is started and the stacker tray 72 is lowered (moved in a Q direction). In this exemplary embodiment, the stacker tray 72 is lowered by, for example, about 17 to 20 mm so as to be located in the position for preventing paper jam.

Then, when the ejection of the subsequent sheet is completed (step S107), the stacker tray 72 is lifted (moved in a P direction) so as to be moved to the basic position (step S108). Then, the process returns to step 5101, in which the stacker tray 72 stands by at the basic position.

FIG. 5D illustrates a state in which a series of operations for squashing swelling of folds are completed and the stacker tray 72 is moved to the basic position. In FIG. 5D, swelling of folds of all the Z-folded sheets is squashed, except the last ejected Z-folded sheet.

The above-described operations for squashing swelling of folds are continuously performed. That is, when the folded portion reaches a predetermined height due to its swelling, the stacker tray 72 is lifted so as to squash the swelling. Then, the stacker tray 72 is lowered so as to stack a sheet, and is lifted again so as to squash swelling. This process is repeatedly performed.

The control unit 7 includes a central processing unit (CPU) for performing arithmetic operations, a memory (ROM) for storing programs, and a main memory serving as a work memory. The CPU reads a program for controlling operations of the stacker tray 72 from the ROM, and thus realizes various functions for controlling the stacker tray 72 using the main memory.

As described above, according to the present exemplary embodiment, it is possible to smoothly stack a sheet subjected to folding processing such as Z-folding onto the stacker tray 72. Usually, when Z-folded sheets are stacked on the stacker tray 72, the sheets are more loosely stacked at the leading edge side due to swelling of folds, so that the thickness of the sheets is increased. In this case, paper jam occurs, unless the sheets are stacked while, for example, lowering the stacker tray 72. However, if the stacker tray 72 is lowered by such a control operation, when a sheet is ejected, the leading edge of the sheet hangs down due to an increased fall length, for example. This might result in a secondary trouble such as paper jam. On the other hand, according to the present exemplary embodiment, when sheets are loosely stacked due to swelling of folds, the stacker tray 72 is lifted so as to squash the swelling, instead of being lowered. This makes it possible to smoothly eject and stack subsequent sheets.

Further, according to the present exemplary embodiment, a Z-folded sheet is squashed by the top tray 74 disposed by its own weight and the lifted stacker tray 72. In the exemplary embodiment, the weight of the top tray 74 is used to squash the folded portion. In this case, if the top tray 74 is a fixed tray, when the sheets are squashed and hardened gradually by the sheet squashing processing, the hardened sheets might hit the lifted stacker tray 72 and thus damage the top tray 74. In the present exemplary embodiment, the top tray 74 is not a fixed tray, but is configured to be pushed up when a large impact is applied. With this configuration, it is possible to squash the sheets while preventing damage to the top tray 74.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus comprising:

a vertically movable tray that moves vertically in accordance with an amount of stacked folded sheets which are transported and stacked thereon;

a plate that is disposed above the vertically movable tray and that does not move in accordance with transport of a folded sheet;

a recognizing unit that recognizes a predetermined height state of a sheet stacked on the vertically movable tray; and a controller that controls the vertically movable tray so as to, in response to a recognition of the predetermined height state of the sheet by the recognizing unit, move the vertically movable tray upward, press the sheet stacked on the vertically movable tray against the plate, and subsequently move the vertically movable tray downward, wherein the plate does not move during a period spanning from when the folded sheet is transported to the vertically movable tray to when the sheet stacked on the vertically movable tray is pressed against the plate.

2. A sheet processing apparatus comprising:

a vertically movable tray that moves vertically in accordance with an amount of stacked folded sheets which are transported and stacked thereon;

a setting clamp that presses an upstream portion of a stacked sheet in a transport direction;

a plate disposed above the vertically movable tray;

a recognizing unit that recognizes a predetermined height state of a sheet stacked on the vertically movable tray; and a controller that controls the vertically movable tray so as to, in response to a recognition of the predetermined height state of the sheet by the recognizing unit, move the vertically movable tray upward, press a downstream portion of the sheet in the transport direction, which is stacked on the vertically movable tray, against the plate, and subsequently move the vertically movable tray downward.

3. The sheet processing apparatus according to claim 1, wherein:

the recognizing unit recognizes that a folded-over position of a Z-folded sheet stacked on the vertically movable tray is in the predetermined height state.

4. The sheet processing apparatus according to claim 1, wherein the plate has a fulcrum at an upstream portion thereof in a sheet transport direction, and a portion of the plate on a downstream side of the fulcrum in the sheet transport direction is rotationally movable to a position above the fulcrum.

5. The sheet processing apparatus according to claim 1, wherein the plate receives, by a weight of the plate, the sheet pushed up by an upward movement of the vertically movable tray, and if a force applied to the sheet by the upward movement of the vertically movable tray is greater than a force of receiving the sheet by the weight of the plate, the plate moves rotationally upward.

6. The sheet processing apparatus according to claim 1, further comprising:

a transporting unit that transports a folded sheet;

wherein after pressing the sheet against the plate, the controller lowers the vertically movable tray to a position where the sheet transported by the transporting unit is stacked thereon.

7. The sheet processing apparatus according to claim 1, wherein the plate is a paper output tray that stacks non-folded sheets.

8. The sheet processing apparatus according to claim 1, wherein the recognizing unit is disposed on a lower surface of the plate.

9. The sheet processing apparatus according to claim 1, wherein the vertically movable tray and the plate have a relationship such that a vertical distance therebetween on a downstream side in a transport direction is less than a vertical distance therebetween on an upstream side in the transport direction.

10. An image forming system comprising:

an image forming unit that forms an image on a transported sheet;

a folding processing unit that performs folding processing on the sheet on which the image is formed by the image forming unit;

a vertically movable tray that stacks the sheet subjected to the folding processing and that is vertically movable;

a plate that is disposed above the vertically movable tray and that does not move in accordance with transport of a folded sheet;

a recognizing unit that recognizes a predetermined height state of the sheet stacked on the vertically movable tray; and a controller that controls the vertically movable tray so as to, in response to a recognition of the predetermined height state of the sheet by the recognizing unit, move the vertically movable tray upward, press the sheet stacked on the vertically movable tray against the plate, and subsequently move the vertically movable tray downward, wherein the plate does not move during a period spanning from when the folded sheet is transported to the vertically movable tray to when the sheet stacked on the vertically movable tray is pressed against the plate.

* * * * *